United States Patent [19]

Guerard et al.

[11] Patent Number: 4,753,251

[45] Date of Patent: Jun. 28, 1988

[54] PERMANENT WAVE HAIR-CURLER

[76] Inventors: Francois Guerard, 163 rue de la Pompe, 75, 116 Paris; Franco Della Casa, 25 rue Voltaire, 92 250 La Garenne Colombes, both of France

[21] Appl. No.: 905,340

[22] PCT Filed: Apr. 2, 1985

[86] PCT No.: PCT/FR85/00073

§ 371 Date: Sep. 22, 1986

§ 102(e) Date: Sep. 22, 1986

[87] PCT Pub. No.: WO86/03953

PCT Pub. Date: Jul. 17, 1986

[30] Foreign Application Priority Data

Jan. 3, 1985 [FR] France ..... 85 00020

[51] Int. Cl.[4] ..... A45D 2/00

[52] U.S. Cl. ..... 132/38 A; 132/32 R; 132/40

[58] Field of Search ..... 132/9, 32 R, 31 R, 38 R, 132/40, 38 A, 50 AB, 51, 52

[56] References Cited

U.S. PATENT DOCUMENTS

| | | | |
|---|---|---|---|
| 2,285,653 | 6/1942 | Haberman | 132/32 R |
| 2,599,505 | 6/1952 | Witmer | 132/32 R |
| 4,261,375 | 4/1981 | Anderson | 132/32 R |

FOREIGN PATENT DOCUMENTS

| | | |
|---|---|---|
| 2024807 | 3/1971 | Fed. Rep. of Germany . |
| 2835477 | 2/1980 | Fed. Rep. of Germany . |
| 605781 | 6/1926 | France . |
| 677708 | 3/1930 | France . |
| 795604 | 3/1936 | France . |
| 2553642 | 4/1985 | France . |

*Primary Examiner*—Robert P. Swiatek
*Assistant Examiner*—J. Hakomaki
*Attorney, Agent, or Firm*—Larson and Taylor

[57] ABSTRACT

The hair-curler is comprised of two parts capable of being assembled, a first part having a socket (20) and a plurality of rectilinear or curved cylindrical pins (21, 22, 23) and having a pointed end and a second part comprising a socket (30) provided with holes (31, 32, 33) for the points and pins (27, 28, 29) intended to be alternatingly arranged with the pins of the first part. The pins (27, 28, 29) are either fixed to the socket (30) or removable and individually mounted on said socket, slots (34, 35, 36) being then provided.

15 Claims, 3 Drawing Sheets

Figure 1:
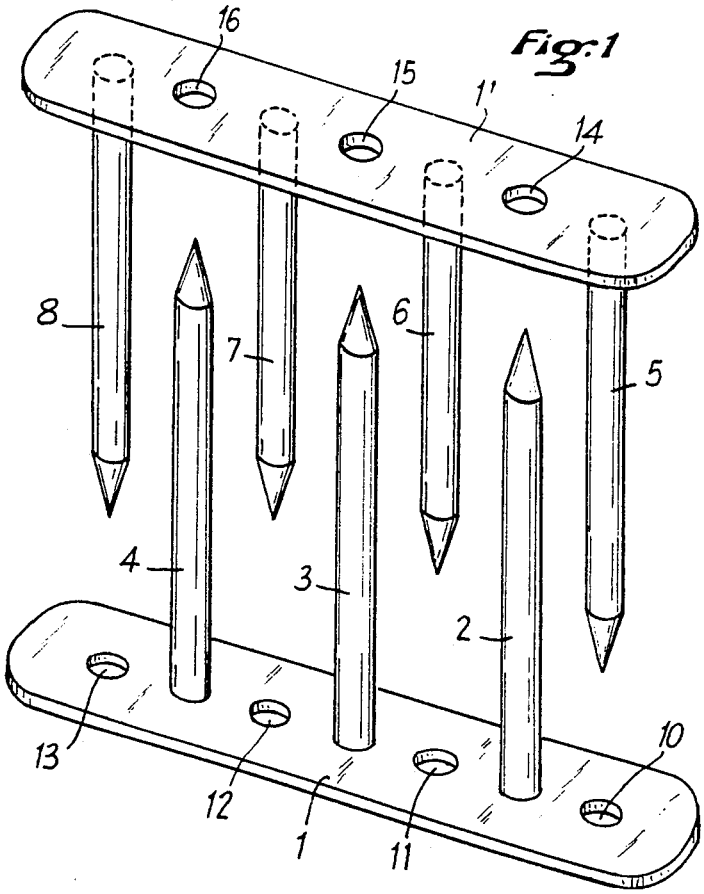

36
37
33
38
39
40
30
35
32
34
31
29
23
22
38
40
39
26
21
25
20
24

30
29
27
28
20

PERMANENT WAVE HAIR-CURLER

The present invention relates to a permanent wave hair-curler and more particularly to a hair-curler permitting the obtainment of a large-area waving of a large part of the head of hair.

Many models of hair-curlers have been proposed which permit the obtainment of a waving of the hair. The hair-curlers generally used have however the drawback of permitting the waving of only a single lock at a time so that a large number of hair-curlers must be used.

There has been described in French Pat. No. 605,781 an apparatus for waving the hair which permits the obtainment of waves in relatively large parts of the head of hair. The waving apparatus described in this patent comprises two or more elements each formed by two parallel rods connected at a single end by a pin about which pivots a fork formed by two pointed rods each of which may be brought between the two rods of an element.

This device permits the obtainment of a wave by inserting the fork under the hair against the scalp. However, it is not very practical and is fragile and the maintenance of the closed-up position is imperfectly ensured unless there are provided heavy and complicated locking mechanisms which may become out of adjustment.

The applicant has tried to design a hair-curler which permits the obtainment of large-area waves in a large part of the head of hair and which is both strong, stable and capable of being immediately placed in position.

The permanent wave hair-curler according to the invention, which comprises sharp-pointed cylindrical rods capable of being brought under the hair parallel to the scalp, and rods capable of being disposed on the hair on each side of said sharp-pointed rods, is characterized in that it is formed by two separate parts one of which has said rods ,which may be brought under the hair while the other has said rods capable of being disposed on the hair, said parts being capable of being assembled in such a manner as to obtain a regular alternation of the rods disposed under the hair and the rods disposed on the hair.

Owing to this continuous alternation of inner rods placed under the hair and outer rods placed on the hair, it is possible to obtain a large-area waving of a large part of the head of hair.

The rods of each part are carried by a support element or base from which they extend in parallel directions, holes being provided in the base for the passage of the ends of the rods of the other part.

The two parts of the hair-curler are assembled simply and rapidly by the engagement of the pointed ends of the rods in the holes of the base of the other part whose diameter substantially corresponds to the diameter of the rods.

In a particularly simple embodiment of the invention, the two parts of the hair-curler comprise sharp-pointed rods connected to a base, each part being thus capable of performing the function of inner and outer rods. The holes are disposed in each base in the gaps between the rods so as to receive the ends of the rods of the other part.

In a preferred embodiment of the invention, the cylindrical rods are curved so as to match the curvature of the scalp corresponding to the zone in which the hair-curler is placed. This is the case in particular for hair-curlers intended to be placed in position on the parietal or occipital zone of the scalp, while the cylindrical rods of hair-curlers intended for the temporal zones may be less curved or rectilinear.

Preferably, whether the rods be rectilinear or curved and irrespective of the curvature of the cylindrical rods, the gaps between the rods and/or the diameters of the rods are variable in a given hair-curler so as to result in an unevenness of the waving of natural appearance.

In an arrangement of the invention of particular interest, the rods of the part intended to be applied, not under the hair of the concerned zone of the scalp but on top of the hair and in the gaps between the rods of the first part, are provided with rapid fixing means, and these rapid fixing means preferably comprise, at least on the base of one of the parts, slots which terminate in turning-back parts for immobilizing narrow extensions of the concerned cylindrical rods.

Preferably, the cylindrical rods, which are curved or not curved, of the part intended to be applied under the hair, against the scalp, form with their support a rigid assembly in one piece which may thus be easily placed in position under the hair owing to the pointed ends of said rods.

The rods of the other part may also be rigidly connected to their base which is preferably provided with holes for the passage of the points of the first part, but, as a variant, the rods of this second part may be completely detachable and mounted individually on the hair-curler.

In the preferred embodiment of the invention, the cylindrical rods of the second part include rapid fixing means cooperating with corresponding means of the bases so as to be capable of being individually mounted between the cylindrical sharp-pointed rods, so that it is possible for the user, who possesses a suitable set of rods, to place in position, in the gaps between sharp-pointed rods, rods of any desired diameters.

Figure 2:
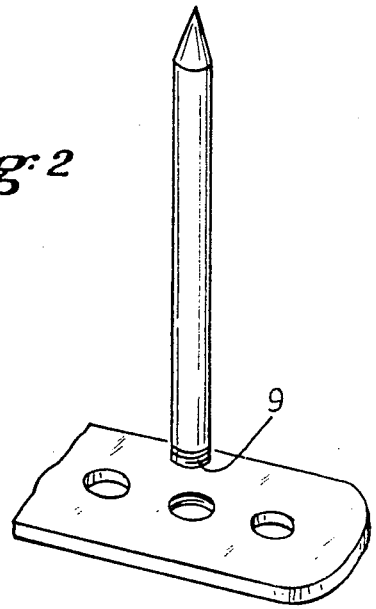
Figure 3:
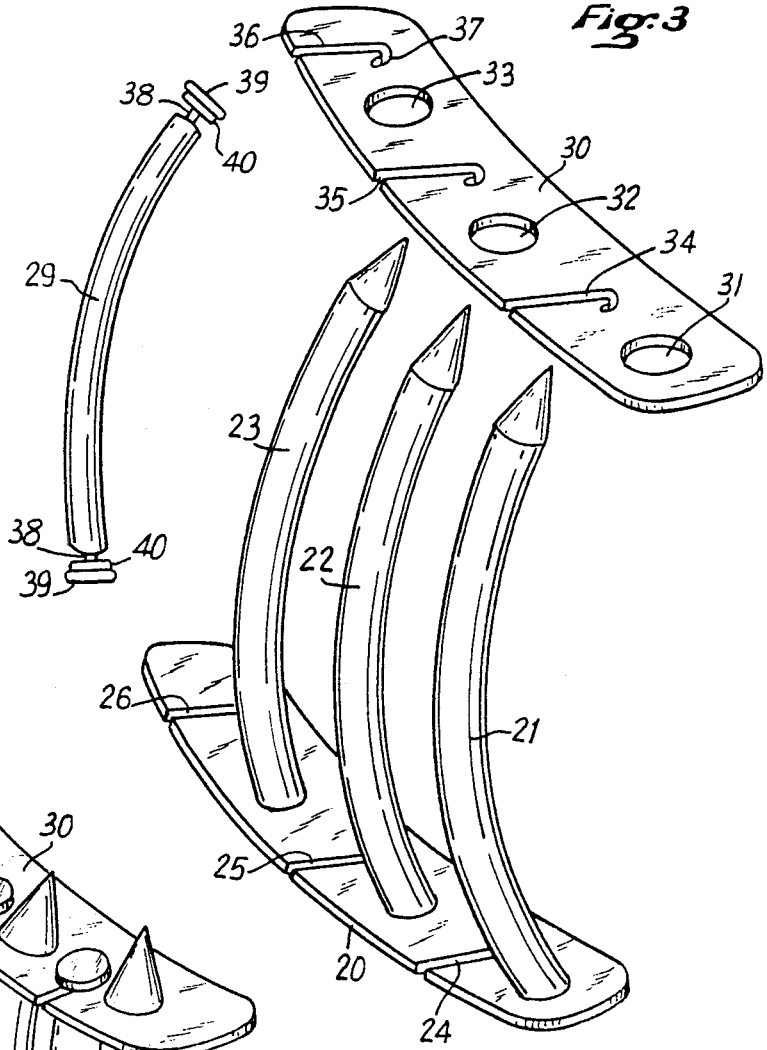
Figure 4:
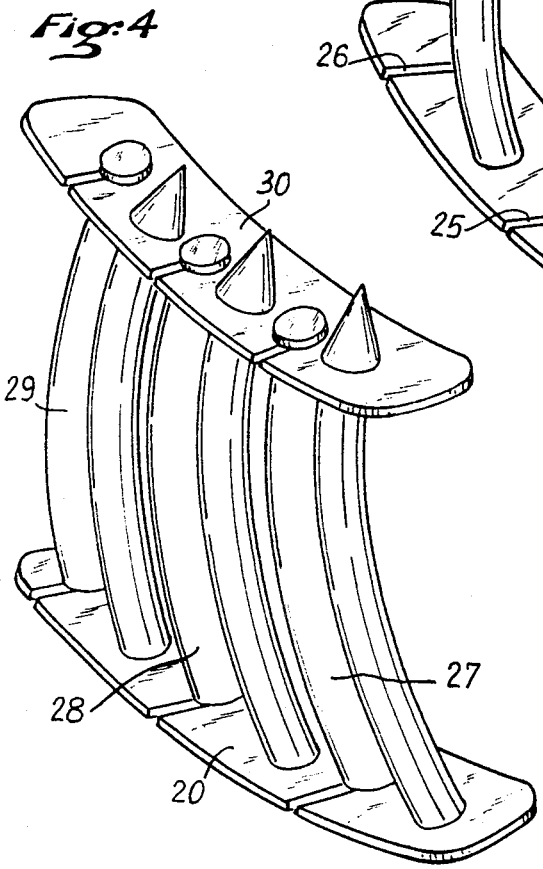
Figure 5:
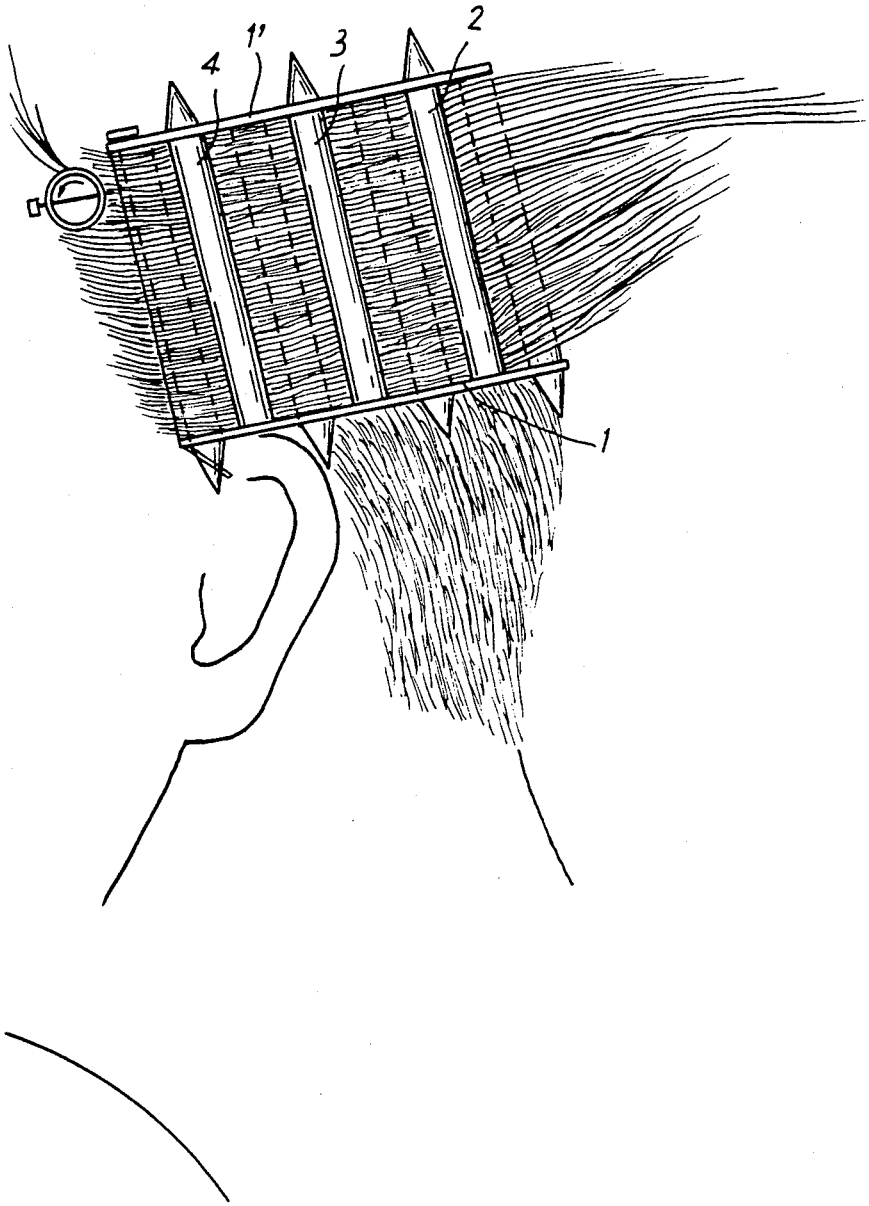

Other advantages and characteristics of the invention will be apparent from the following description which is given as a non-limiting example, with reference to the accompanying drawing, in which:

FIG. 1 represents a hair-curler before assembly whose two parts are provided with sharp-pointed rods, FIG. 2 represents the assembly of a rod on its base, FIG. 3 represents a view of a first part provided with sharp-pointed curved rods disposed in the vicinity of the base of the other part, a single rod of the other part being shown, FIG. 4 represents the hair-curler of FIG. 3 in the assembled state, FIG. 5 illustrates the manner of using a hair-curler according to the invention.

There has been shown in FIG. 1 a hair-curler whose two parts are provided with sharp-pointed rods. Each part is composed of a base 1 and 1', made for example from a plastics material and having the shape of a strip curved in the manner of a sword. Placed under the bases 1 and 1' at irregular intervals are respectively three rods 2, 3, 4 and four rods 5, 6, 7, 8 having a cylindrical shape and pointed ends. As shown in FIG. 2, the rods may have a screwthreaded end 9 and may be screwed into the base. The base 1 further comprises four holes 10, 11, 12 and 13 disposed in the gaps between the rods and having diameters respectively corresponding to the diameters of the rods 5, 6, 7 and 8, said holes being adapted to receive the pointed ends of these rods for the assembly of the hair-curler. The base 1' comprises in the same way three holes 14, 15 and 16 whose diameters respectively correspond to the diameters of the rods 2, 3 and 4 and into which extend the pointed ends of these rods when the hair-curler is assembled.

There has been shown in FIGS. 3 and 4 a variant of the construction of the hair-curler according to the invention in which the cylindrical rods are curved. The first part of such a hair-curler comprises a base 20 which is advantageously made from a plastics material and has the same shape as the base of the hair-curler shown in FIG. 1. Secured to this base 20, at irregular intervals, are three rods 21, 22 and 23 of curved cylindrical shape, as can be seen in the Figures. The connection between the rods 21, 22, 23 and the base 20 may be achieved in any way, such as by adhesion, screwing, forming over or by an injection moulding of the whole of this part in a single piece. By way of a modification, the rods 21, 22, 23 may be fixed to the base 20 in a detachable manner by screwing or other means.

The base 30 of the other part also has the shape of a flattened sword blade similar or identical to that of the base 20, and this base 30 has, arranged at the pitch of the rods 21, 22, 23, holes 31, 32, 33 of corresponding diameters into which the pointed ends of the rods 21, 22, 23 are adapted to extend for the assembly of the hair-curler.

Disposed between the holes 31, 32, 33 and beyond the hole 33 are slots 34, 35, 36 which terminate, as can be seen, in a turning-back part adapted for hooking purposes.

The base 20 has identical slots 24, 25 and 26 corresponding to the slots 34, 35, 36.

The rods 27, 28, 29 of the second part are separately and individually detachable. They have a curved cylindrical body, as the rods 21, 22 and 23. They include at their ends fixing means adapted to cooperate with the slots 34, 35, 36 and with the slots 24, 25, 26 respectively. These means preferably comprise a short filiform part 38 extending the cylindrical body of the rod and terminating in a flattened end portion 39 under which a deformable elastic washer 40 is secured, the distance between the end of the body 29 and the washer 40 being preferably slightly less than the thickness of the bases 20 and 30 so as to permit both an easy positioning of the rods 27, 28, 29 on top of the hair in the gaps between the rods 21, 22, 23 and a maintenance of said rods 27, 28, 29 in a sufficiently rigid manner.

The number of cylindrical rods having pointed ends, such as 21, 22, 23, may vary and be 2 or more, but this number is preferably equal to 3, 4 or 5. The length of these rods varies as a function of the desired requirements and of the zone that they must cover on the scalp. This length is preferably on the order of 10 to 25 centimeters.

The diameter of the rods preferably varies from 10 to 20 millimeters.

The spacing between the elements, i.e. the width of the gaps between two successive rods of a given part of the hair-curler, preferably varies between 15 and 30 millimeters.

There has been illustrated in FIG. 5 the manner of using a hair-curler represented in FIG. 1. It can be seen that this hair-curler covers a vast zone of the scalp. This is an important advantage of the hair-curler according to the invention, since a very small number of hair-curlers is sufficient to achieve the waving of the whole of the head of hair. The hair-curler is placed in position by bringing one of the parts provided with sharp points under the hair parallel to the scalp, placing in position the hair of a large zone of the head of hair, and then applying on top of the hair for example the rods 2, 3, 4 of the other part which are engaged by their pointed ends in the holes of the base 1' and which come to occupy substantially the gaps between the rods of the first part so that the hair is pinched and waved.

Although the invention has been described with reference to a particular embodiment, it must be understood that it is in no way limited thereto and that various modifications as concerns form or material may be made without departing from the scope or spirit of the invention.

We claim:

1. A hair-curler permitting the permanent waving of hair, comprising sharp-pointed cylindrical rods capable of being brought under the hair, parallel to a scalp, and rods capable of being disposed on the hair on each side of said sharp-pointed rods, characterized in that it is formed by two separate parts, one of which has said rods (2, 3, 4; 21, 22, 23) capable of being brought under the hair whereas the other has said rods (5, 6, 7, 8; 28, 29) which are capable of being disposed on the hair, said rods being capable of being assembled in such manner as to obtain a regular alternation of rods disposed under the hair and rods disposed on the hair.

2. A hair-curler according to claim 1, characterized in that the sharp-pointed rods (2, 3, 4; 21, 22, 23) of a part extend from a common base (1, 20).

3. A hair-curler according to claim 1 characterized in that the sharp points extend, for the assembly of the two parts, into the holes (14, 15, 16; 31, 32, 33) provided in a base of the other part.

4. A hair-curler according to claim 2, characterized in that each part comprises sharp-pointed rods (2, 3, 4; 5, 6, 7, 8) and a base (1, 1') from which said rods extend, holes (10, 11, 12, 13; 14, 15, 16) being disposed in each base in the gaps between the rods.

5. A hair-curler according to claim 1, characterized in that the cylindrical rods (21, 22, 23; 27, 28, 29) are curved in such manner as to match the curvature of the scalp corresponding to the zone in which the hair-curler is placed.

6. A hair-curler according to claim 1, characterized in that the rods (27, 28, 29) of the other part intended to be applied on the hair are provided with fixing means for rapidly fixing the rods of the other part to respective bases (20, 30) of the one part and of the other part.

7. A hair-curler according to claim 6, characterized in that said rapid fixing means comprise, on both the bases (20, 30), slots (24, 25, 26; 34, 35, 36) terminating in turned-back parts (37) permitting the immobilization of narrow extensions (38) of the concerned cylindrical rods of the other part.

8. A hair-curler according to claim 1, characterized in that the sharp-pointed cylindrical rods of the one part intended to be applied under the hair, against the scalp, form with a base (1, 20) a rigid unit in one piece.

9. A hair-curler according to claim 1, characterized in that the rods of the other part intended to be applied on the hair, in the gaps between the rods of the part, are completely detachable and may be individually mounted on the hair-curler.

10. A hair-curler according to claim 6, characterized in that said detachable cylindrical rods comprise, at their ends, filiform extensions (38) followed by a flattened end portion (39) under which a deformable elastic washer (40) is fixed.

11. A hair-curler according to claim 1, characterized in that one of the parts comprises a support base (1', 1) having a hole which is adapted to receive the sharp point terminating the rods of the other of the parts.

12. A hair-curler according to claim 1, characterized in that gaps between the rods are different so as to produce an unevenness of natural appearance of the head of hair.

13. A hair-curler according to claim 2, characterized in that the rods (2, 3, 4; 21, 22, 23) are fixed in the base.

14. A hair-curler according to claim 2, characterized in that the rods (2, 3, 4; 21, 22, 23) are screwed into the base.

15. A hair-curler according to claim 1, characterized in that the length of the rods is on the order of 10 to 25 cm, the diameter of the rods is 10 to 20 mm and the spacing between two successive rods of a given part is between 15 to 30 mm.

* * * * *